US008276248B2

(12) United States Patent
Cox et al.

(10) Patent No.: US 8,276,248 B2
(45) Date of Patent: Oct. 2, 2012

(54) THROW ASSEMBLY FOR CASKET

(75) Inventors: Gary L. Cox, Richmond, IN (US); Chad Eversole, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 12/815,279

(22) Filed: Jun. 14, 2010

(65) Prior Publication Data

US 2011/0107567 A1 May 12, 2011

Related U.S. Application Data

(60) Provisional application No. 61/186,873, filed on Jun. 14, 2009.

(51) Int. Cl.
*A61G 17/00* (2006.01)

(52) U.S. Cl. ..... 27/19

(58) Field of Classification Search ..... 27/19, 14, 27/4, 2; D99/10; 229/164.2; 220/495.01; 2/272, 255; 150/158; D06/603
See application file for complete search history.

(56) References Cited

U.S. PATENT DOCUMENTS

| | | | | | |
|---|---|---|---|---|---|
| 1,952,439 | A * | 3/1934 | Jones | 52/511 |
| RE25,545 | E * | 3/1964 | White | 27/19 |
| 3,233,302 | A * | 2/1966 | Ross | 27/6 |
| 3,395,431 | A * | 8/1968 | Carson, Jr. | 27/19 |
| 5,784,768 | A * | 7/1998 | Rojdev | 27/19 |
| 6,105,221 | A * | 8/2000 | Cox | 27/19 |
| 6,151,762 | A * | 11/2000 | Cox | 27/19 |
| 7,069,627 | B2 | 7/2006 | Cunningham et al. | |
| 7,254,875 | B2 * | 8/2007 | Wray et al. | 27/19 |

* cited by examiner

*Primary Examiner* — William L. Miller

(74) *Attorney, Agent, or Firm* — Maginot, Moore & Beck

(57) ABSTRACT

A throw assembly for a casket container includes a corrugated paper having a corner cutout configured to be longitudinally folded along each of two parallel longitudinal lines and transversally folded about the corner cutout, and a fabric member disposed over the corrugated paper structure, and fixedly coupled to the corrugated paper structure along at least one edge of the fabric member.

19 Claims, 5 Drawing Sheets

THROW ASSEMBLY FOR CASKET

CROSS-REFERENCE TO RELATED APPLICATIONS

This application claims priority from U.S. Provisional Patent Application No. 61/186,873, filed Jun. 14, 2009, the contents of which are incorporated herein by reference in their entirety

FIELD

The present invention relates to caskets and decorative items used in connection with caskets.

BACKGROUND

Burial or cremation containers, referred to herein collectively as caskets, typically include a container and a lid. The lid may include a head portion and a body portion. The head portion may be selectively opened for viewing. Between the container and the lid is a gasket or seal, which is typically attached to a top edge of the container. The gasket, however, may be fixedly attached to the lid as an alternative.

When the head portion of the lid (or the entire lid) is opened for viewing prior to interment, the top edge of the container can have a finish or aesthetic appearance that detracts from the overall aesthetic appearance of the casket. This is particularly true in most cases where the gasket or seal is fixedly attached to the top edge of the container.

To avoid the detrimental appearance, it is known to provide a temporary cover for the top edge of a casket while it is opened for viewing. One known method involves a "throw" made of padded fabric that is sewn to the bedding or other fabric inside the casket, and which may be thrown or draped over the top edge of the casket to provide a soft, fabric cover to the top edge. The throw has some disadvantages in the difficulty in obtaining and maintaining a neat and orderly appearance when in use. Manufacturing difficulties and costs are also disadvantageous.

Other methods of covering the exposed top edge of a casket container include a rigid cover that just covers the top edge and connects via glue or mechanical means. Such methods are discussed in U.S. Pat. No. 7,069,627 to Cunningham, et al.

At least one solution disclosed in these patents includes cloth and padding around a rigid cap or cover structure. The cloth and padding wrapped cover is then fixed to the upper edge of the casket.

While these solutions overcome some of the problems of the prior art, they nevertheless involve cost issues, and in some cases complexity of implementation. For example, some of the devices include multiple pieces that must be assembled on to the casket for the viewing. Such assembly must necessarily occur at the funeral location, and thus would be carried out by a wide variety of operators who are independent from the manufacturer.

A solution is needed, therefore, that is inexpensive to manufacture and simple to use.

SUMMARY

According to one embodiment of the present disclosure, a throw assembly for a casket container includes a corrugated paper structure and a fabric member. The corrugated paper structure has a cutout and is configured to be longitudinally folded along each of two parallel longitudinal lines and transversally folded about the cutout. The fabric member is disposed over the corrugated paper structure and is fixedly coupled to the corrugated paper structure along at least one edge of the fabric member.

In another embodiment, a corresponding casket assembly including such a throw assembly.

The corrugated paper structure and fabric form a convenient and aesthetically pleasing cover to exposed edges of a casket.

The above described features and advantages, as well as others, will become more readily apparent to those of ordinary skill in the art by reference to the following detailed description and accompanying drawings.

DESCRIPTION

Figure 1:
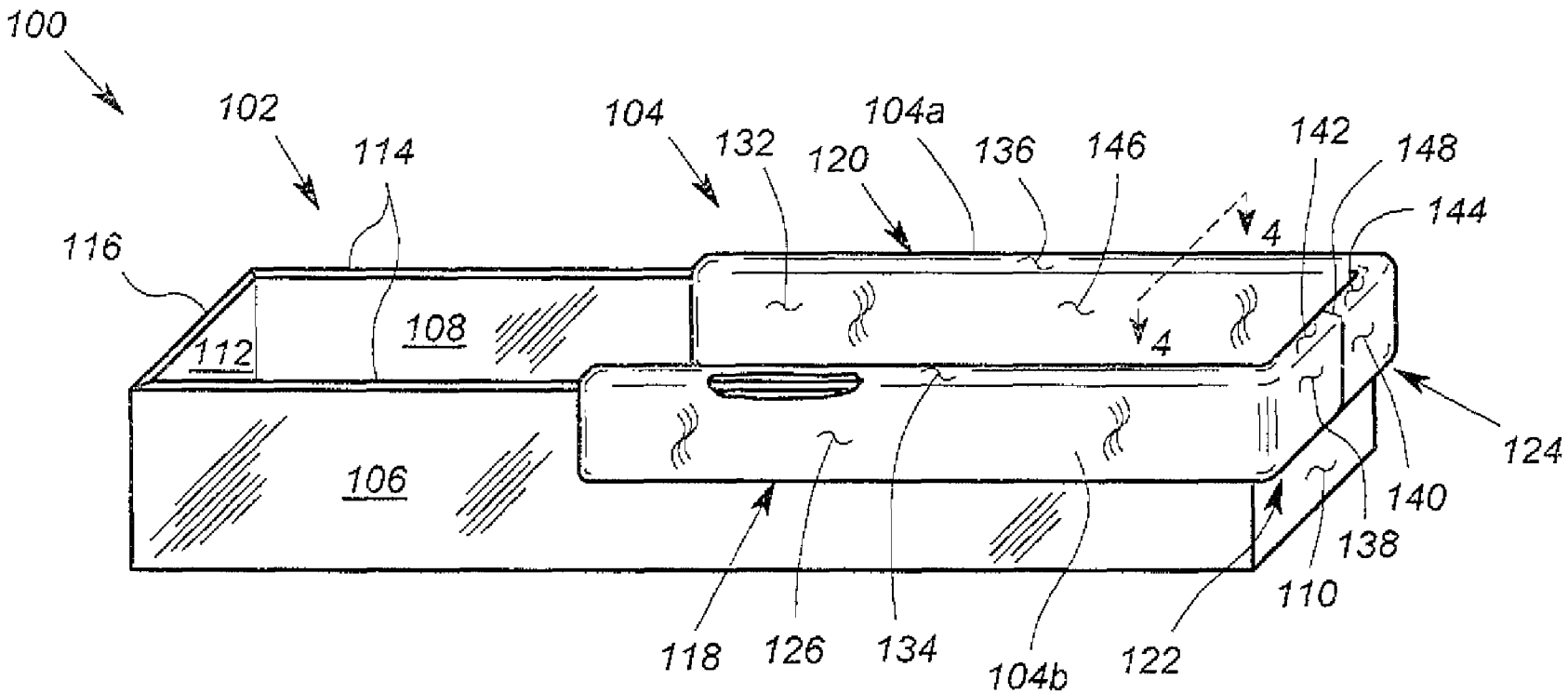
FIG. 1 depicts a perspective view of a casket container including a container and a throw assembly.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Referring to FIG. 1, a perspective view of a casket container 100 is provided. The casket container 100 includes a container 102 and a throw assembly 104. The container 102 is in a shape of a rectangular hollow box. The container 102 includes side walls 106 and 108 and end walls 110 and 112. The side walls 106 and 108 terminate in longitudinal edges 114 while end walls 110 and 112 terminate in transversally disposed edges 116 (only one edge 116 is shown).

The throw assembly 104 includes two "L" shaped halves 104*a*, 104*b*. Each half 104*a*, 104*b* is defined by longitudinal portions 118/120 and transversally disposed portions 122/124. The longitudinal portions 118/120 are defined by outside vertical faces 126/128 and by inside vertical faces 130/132. The longitudinal portions 118/120 are further defined by horizontal faces 134/136. The transversally disposed portions 122/124 are defined by vertical faces 138/140 and further by horizontal faces 142/144.

The inside vertical face 132 of the longitudinal portion 120 extends downward by a fabric portion 146. Similarly, the inside portion 130 of the longitudinal portion 118 also extends downward by a fabric portion (not shown) as do inside faces of the transversally disposed portions 122 and 124 (not shown).

The "L" shaped halves 104*a*, 104*b* may be placed over the top edges 114/116 of the side and end walls of the container 102. An opening depicted in the top face 134, for example, shows the top edge 114 under the longitudinal portion 118. The two "L" shaped halves are joined at a joining line 148 above the top edge of the end wall 110. In an alternative embodiment, a single "L" shaped half may cover all or most of the top edge. Such embodiments, may include those in which the lid of the casket is hinged, and only a portion of one side wall and end wall are covered by the throw assembly. In this embodiment, wherein the lid (or portion of the lid) of a casket is completely removed, two complementary "L" shaped halves 104*a*, 104*b* are used.

Figure 2:
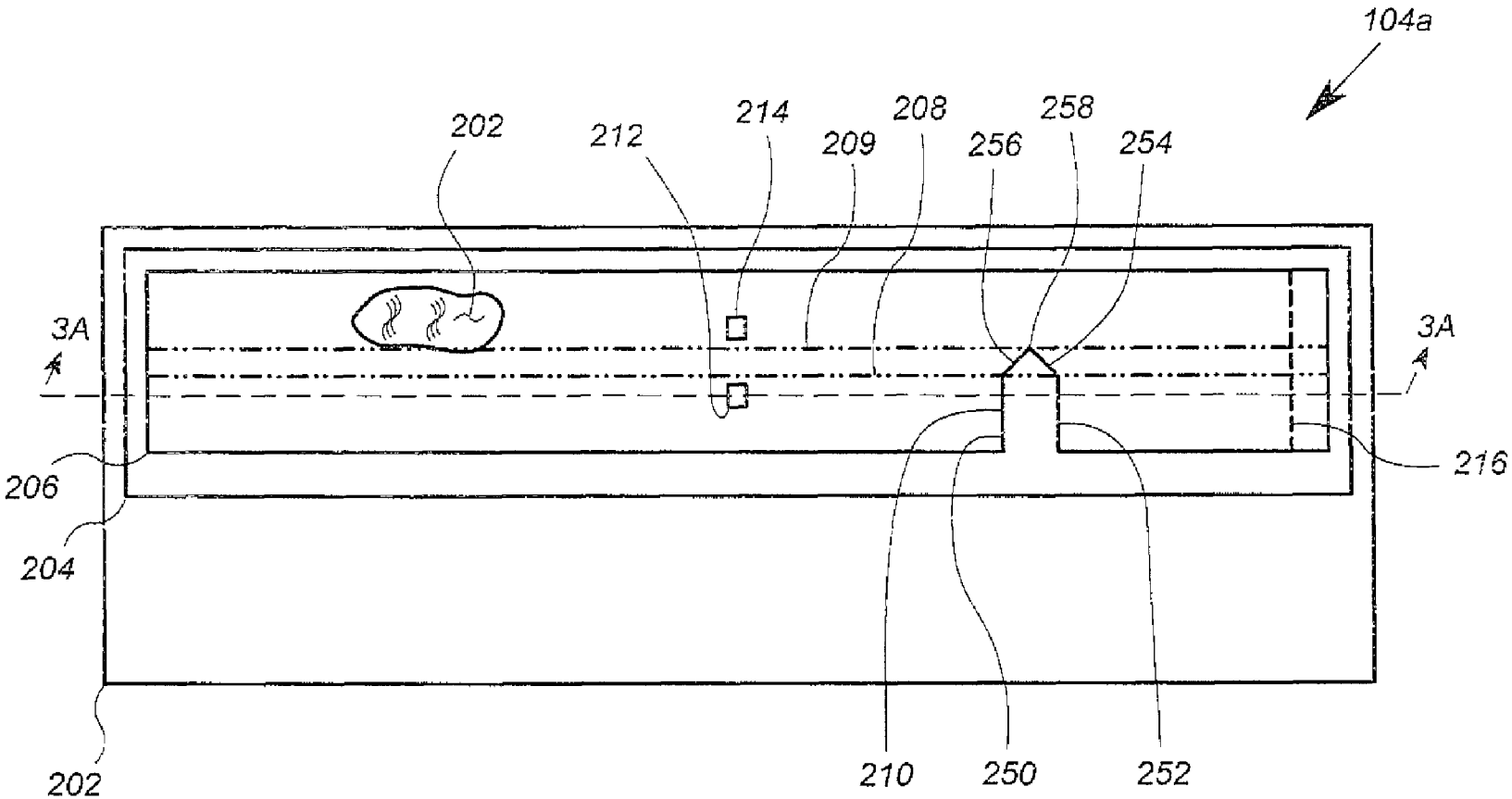
FIG. 2 depicts a plan view of the throw assembly of FIG. 1 prior to being assembled.

Referring to FIG. 2, a plan view of partially unassembled throw assembly piece 104*a* is depicted. The unassembled throw assembly 104*a* includes a fabric 202, a pad 204, and a corrugated paper structure 206, all in shapes of rectangles of varying sizes. The corrugated paper structure 206 includes fold lines 208 and 209, in the form of perforations, and a corner cutout 210. Also, the corrugated paper structure 206 includes centrally located holes 212 and 214. An opening in the corrugated paper structure 206 reveals the pad 204 disposed under the paper.

The fold lines 208 and 209 are configured to allow folding of the corrugated paper structure 206 along the length of the paper. Therefore, the two fold lines 208 and 209 provide an elongated "U" shaped pattern for the corrugated paper structure 206 when the paper is folded about these fold lines.

The corner cutout 210 in this embodiment includes two side edges 250, 252 that extend transversely from a first longitudinal edge of the corrugated paper structure 206, and two converging edges 254 and 256 that converge to a point 258 at a location between the first longitudinal edge and a second longitudinal edge of the corrugated paper structure. Preferably, each of the two converging edges 254 and 256 extends substantially between the two parallel longitudinal lines 208, 209, and the two side edges 250, 252 extend from the first longitudinal edge to the two longitudinal line 208. This structure of the corner cutout 206 facilitates the folding process to form the L-shape.

An optional cutout 216 may also be provided, which as described below can be configured to provide a cavity for receiving optional hardware of the corrugated paper structure 206 of the end wall 110 (see FIG. 1).

Figure 3A:
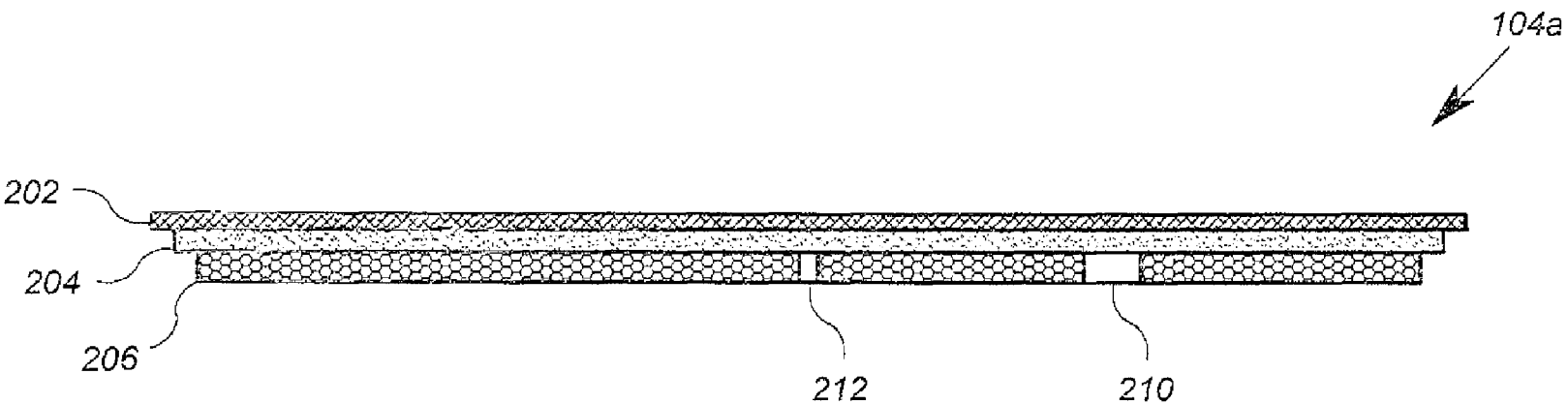
FIG. 3A depicts a cross sectional view along a longitudinal axis depicted in FIG. 2.

FIG. 3A depicts a cross sectional view of the partially unassembled throw assembly half 104*a* about a longitudinal axis 3A-3A (see FIG. 2). The combination of the fabric 202, the pad 204 and the corrugated paper structure 206 is depicted. The corner cutout 210 and the hole 212 are also depicted.

Prior to folding the halves of the throw assembly 104, in order to achieve the "L" shaped pattern depicted in FIG. 1, the pad 204 is sized so that it can be extended over the corrugated paper structure 206. Similarly, the fabric 202 is sized so it can be extended over the corrugated paper structure 206 and the pad 204, such that long edges of the fabric 202 and the pad 204 extend a number of inches past long edges of the corrugated paper structure 206.

Figure 3B:
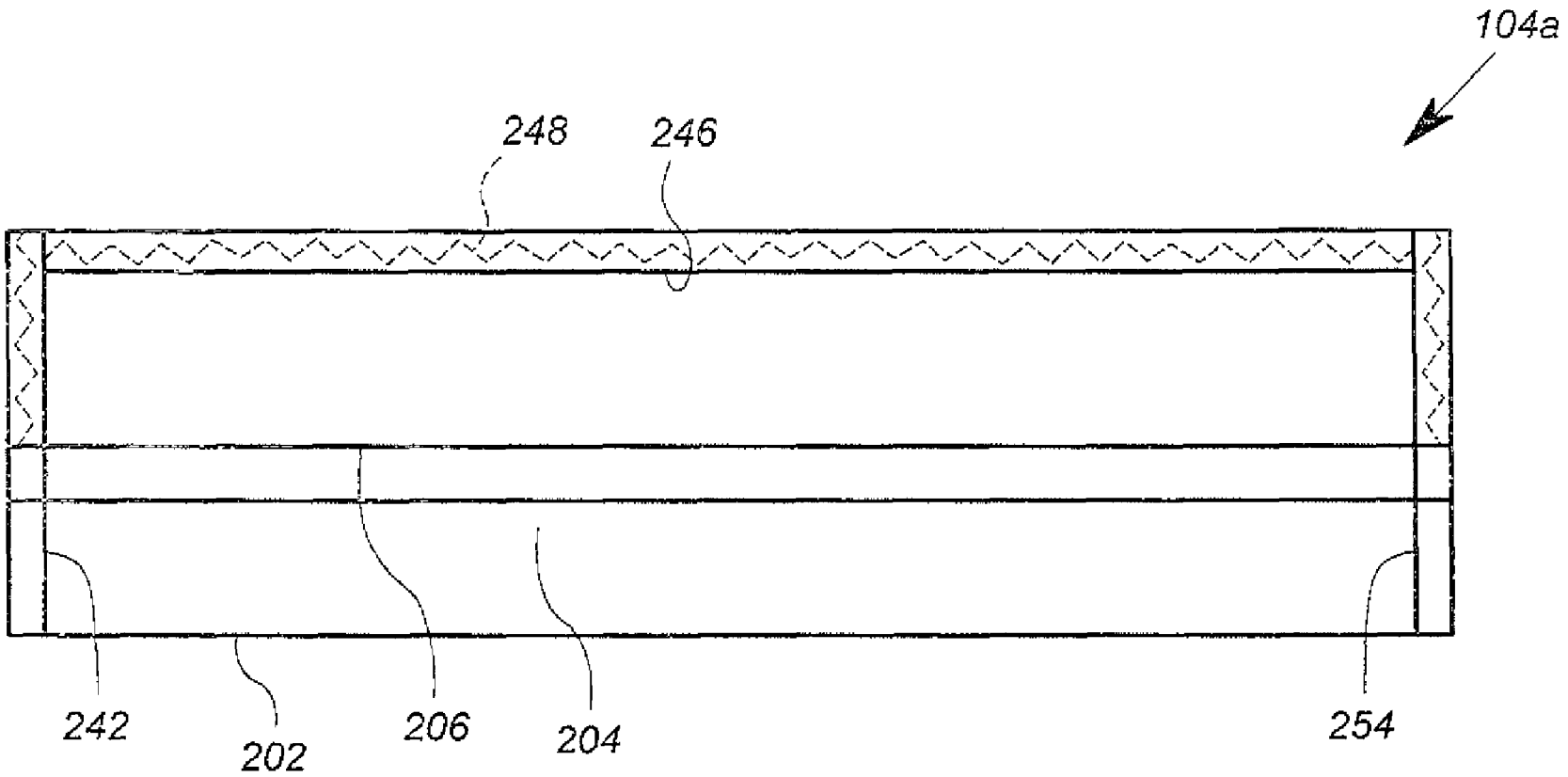
FIG. 3B depicts a plan view of the throw assembly of FIG. 1 partially assembled.

Referring to FIG. 3B, a plan view of a partially assembled throw assembly 104*a* is depicted. Portions of the fabric 202 which extend beyond the edges of the corrugated paper body 206 are folded over the short edges generating foldovers 242/244 and over a first long edge generating a foldover 246. The foldovers 242/244/246 are hot-melt glued to inner surfaces of the corrugated paper structure 206 as depicted by the phantom glue marks 248. The foldovers 242/244 continue down the width of the fabric 202. In FIG. 3B, the final fold is yet to be done, and would involve folding up and gluing the fabric 202 onto the second (bottom) long edge of the corrugated paper structure 206.

Once the fabric 202 has been glued to the corrugated paper structure 206, the paper can be folded along the fold lines 208 and 209 (see FIG. 2). This folding operation results in a "U" shaped assembly, as depicted in FIG. 4.

Figure 4:
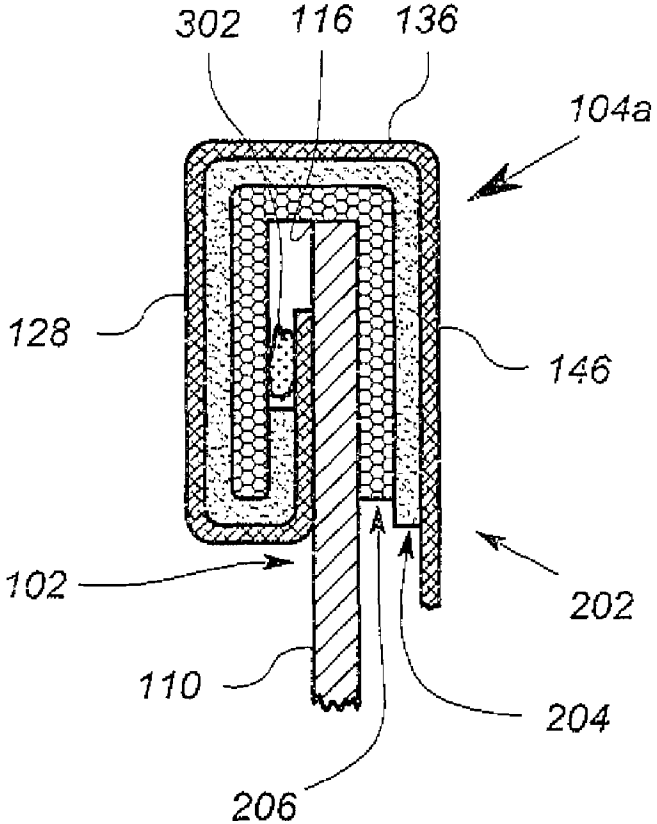
FIG. 4 depicts a cross sectional view along a transversal axis depicted in FIG. 1.

Referring to FIG. 4, a cross sectional view of a section of FIG. 1 along a transversal axis BB is depicted. The side wall 110 of the container 102 is sandwiched between layers of the fabric 202, the pad 204, and the corrugated paper structure 206. A small portion of the pad 204 is folded around the corrugated paper structure 206 while a larger portion of the fabric 202 is similarly folded over the pad 204. The fabric 202 is hot-melt glued to the corrugated paper structure 206 as shown by the glue 302. The fabric 202 and the pad 204 continue around the corrugated paper structure 206. As a result, the outside vertical face 128 (see also FIG. 1) provides a uniform and a visually appealing tailored-look that continues around the perimeter of each "L" shaped half of the throw assembly 104.

The portion 146 of the fabric 202 is left hanging which can be neatly tucked into the inside edge of the container (see also FIG. 1).

During shipment of the container 102, the "L" shaped halves of the throw assembly 104 may be stowed with the container 102. During viewing, the "L" shaped halves is/are placed over the top edges 114, 116 of the side and the end walls to cover the edges and/or any gasket that may be disposed on the top edges 114, 116. In the "L" shaped position, the edges 250, 252 are collapsed toward each other in the interior of the "L" corner. One of the advantageous features is the modular nature of the throw assembly 104, in other words, using two "L" shaped halves. This modular nature allows the throw assembly 104 to be conveniently shipped within an empty casket.

It will be appreciated that the size of the throw assembly 104 may be adjusted to accommodate the amount of the top edge of the container 102 that is exposed during viewing. For example, if only a portion of a lid of a casket is intended to be opened, then the throw assembly 104 would have a size that corresponds to that portion. However, if the entire lid is opened, or removed, then the "L" shaped halves of the throw assembly 104 would have a size that would cover the entire top edge of the container.

As described above, holes 212 and 214 are centrally located on the corrugated paper structure 206. In this embodiment, the holes 212, 214 define places where clips or other fasteners may be used to secure a lid onto the casket 100. These holes may also be configured to allow an assembler to pick the corrugated paper structure 206 by fingers.

Also, as described above the optional cutout 216 may be provided at the corner of the corrugated paper structure 206. After assembly, the cutouts 216 of each half are adjacent to each other and are configured to provide a cavity for optional hardware disposed on the corrugated paper structure 206 on the interior of the container 102.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A throw assembly for a casket container, comprising:

a corrugated paper structure having two parallel longitudinal fold lines and a cutout such that the corrugated paper structure is configured to be longitudinally folded along each of the two parallel longitudinal fold lines and transversally folded about the cutout;

a fabric member disposed over the corrugated paper structure, wherein the fabric member is fixedly coupled to the corrugated paper structure along at least one edge of the fabric member; and a pad disposed between at least a portion of the fabric member and the corrugated paper structure.

2. The throw assembly of claim 1, wherein the fabric member is fixedly coupled to the corrugated paper structure proximate two edges of the fabric member.

3. The throw assembly of claim 1, wherein the fabric member is fixedly coupled to the corrugated paper structure proximate three edges of the fabric member.

4. The throw assembly of claim 1, wherein the fabric member is fixedly coupled to the corrugated paper structure by an adhesive.

5. The throw assembly of claim 4, wherein the adhesive is hot-melt glue.

6. The throw assembly of claim 1, the corrugated paper structure further includes two through holes.

7. The throw assembly of claim 1, the corrugated paper structure further comprising slit scores along the two parallel longitudinal fold lines.

8. A throw assembly for a casket container, comprising:

a corrugated paper structure having two parallel longitudinal fold lines and a cutout such that the corrugated paper structure is configured to be longitudinally folded along each of the two parallel longitudinal fold lines and transversally folded about the cutout; and a fabric member disposed over the corrugated paper structure, wherein the fabric member is fixedly coupled to the corrugated paper structure along at least one edge of the fabric member, wherein the cutout includes two side edges that extend transversely from a first longitudinal edge of the corrugated paper structure, and two converging edges that converge to a point at a location between the first longitudinal edge and a second longitudinal edge of the corrugated paper structure.

9. The throw assembly of claim 8, wherein each of the two converging edges extends substantially between the two parallel longitudinal lines.

10. The throw assembly of claim 9, wherein the two side edges extend from the first longitudinal edge to a first of the two parallel longitudinal fold lines.

11. The throw assembly of claim 8, wherein the two side edges extend from the first longitudinal edge to a first of the two parallel longitudinal fold lines.

12. A casket assembly, comprising:

a container base having two side walls and at least one end wall;

a first throw assembly for the container base, including a corrugated paper structure folded along each of two parallel longitudinal fold lines forming a U-shaped structure in one dimension, and transversally folded to form an L-shaped structure in another dimension;

a fabric member disposed over the corrugated paper structure, wherein the fabric member is fixedly coupled to the corrugated paper structure along at least one edge of the fabric member;

the at least first throw assembly disposed on the container base such that the U-shaped structure extends over edges of at least a portion of a first of the side walls and of at least a first portion of the at least one end wall.

13. The casket assembly of claim 12, further comprising a second throw assembly disposed on at least a portion of a second of the side walls and on at least a second portion of the at least one end wall.

14. The casket assembly of claim 12, wherein the fabric member is fixedly coupled to the corrugated paper structure proximate two edges of the fabric member.

15. The casket assembly of claim 12, further comprising a pad disposed between at least a portion of the fabric member and the corrugated paper structure.

16. The casket assembly of claim 12, wherein the corrugated paper structure further comprises a cutout extending partially inward from a first longitudinal edge of the corrugated paper structure, the cutout disposed proximate a corner defined by the L-shaped structure the at least one end wall and the first side wall, and wherein the cutout facilitates transversally folding the corrugated paper structure to form the L-shaped structure.

17. The casket assembly of claim 16, wherein the cutout includes two side edges that extend transversely from the first longitudinal edge, and two converging edges that converge to a point at a location between the first longitudinal edge and a second longitudinal edge of the corrugated paper structure.

18. The casket assembly of claim 17, wherein each of the two converging edges extends substantially between the two parallel longitudinal fold lines.

19. The casket assembly of claim 16, wherein the two side edges extend from the first longitudinal edge to a first of the two parallel longitudinal fold lines.

* * * * *